US012203347B2

(12) United States Patent
Cochran et al.

(10) Patent No.: US 12,203,347 B2
(45) Date of Patent: Jan. 21, 2025

(54) SCALE/CORROSION INHIBITOR DISPENSER FOR WELLBORE PROTECTION

(71) Applicant: SAUDI ARABIAN OIL COMPANY, Dhahran (SA)

(72) Inventors: Jamie Cochran, Aberdeenshire (GB); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 2 days.

(21) Appl. No.: 18/160,412

(22) Filed: Jan. 27, 2023

(65) Prior Publication Data

US 2024/0254863 A1 Aug. 1, 2024

(51) Int. Cl.
*E21B 41/02* (2006.01)
*E21B 41/00* (2006.01)

(52) U.S. Cl.
CPC ..... *E21B 41/02* (2013.01); *E21B 41/0042* (2013.01)

(58) Field of Classification Search
CPC ..... E21B 41/02; E21B 41/0042
See application file for complete search history.

(56) References Cited

U.S. PATENT DOCUMENTS

| | | | | |
|---|---|---|---|---|
| 4,580,634 | A | 4/1986 | Cruise | |
| 4,889,468 | A | 12/1989 | Ishikura | |
| 7,195,070 | B2 | 3/2007 | Delaloye et al. | |
| 7,896,079 | B2 | 3/2011 | Dyer et al. | |
| 8,276,670 | B2 | 10/2012 | Patel | |
| 8,950,491 | B2 | 2/2015 | Frost | |
| 9,097,094 | B1 | 8/2015 | Frost | |
| 9,303,496 | B2 * | 4/2016 | Xiao | E21B 43/128 |
| 10,837,248 | B2 * | 11/2020 | Hattenbach | E21B 41/02 |
| 11,346,194 | B2 * | 5/2022 | Al-Somali | E21B 34/10 |
| 11,454,090 | B2 * | 9/2022 | Gonzalez-Cabrera | E21B 34/12 |
| 11,767,743 | B2 * | 9/2023 | Lerohl | E21B 43/16 166/305.1 |
| 11,933,127 | B2 * | 3/2024 | Morrison | E21B 27/02 |
| 2003/0131991 | A1 * | 7/2003 | Hartog | E21B 47/11 166/250.12 |

(Continued)

FOREIGN PATENT DOCUMENTS

| | | |
|---|---|---|
| RU | 175467 U1 | 12/2017 |
| RU | 2638383 C1 | 12/2017 |
| RU | 2763199 C1 | 12/2021 |

OTHER PUBLICATIONS

Kan et al., "The state of the art in scale inhibitor squeeze treatment," Petroleum Science, Aug. 19, 2020, 23 pages.

(Continued)

*Primary Examiner* — Taras P Bemko
(74) *Attorney, Agent, or Firm* — Osha Bergman Watanabe & Burton LLP

(57) ABSTRACT

A chemical dispenser system includes a Y-tool secured to a toolstring via a Y-block, the Y-tool comprising a bypass line and a pump line, where the bypass line and the pump line are fluidly connected to the toolstring at an upper end of the Y-block and where the pump line and the bypass line are arranged parallel to each other. The chemical dispenser system further includes an electrical submersible pump provided in the pump line, inhibitor chemicals held within one or more pressure retaining chambers in the bypass line, and a blanking plug landed in the bypass line.

17 Claims, 12 Drawing Sheets

(56) References Cited

U.S. PATENT DOCUMENTS

| | | | | |
|---|---|---|---|---|
| 2006/0231256 | A1* | 10/2006 | Rivas | E21B 43/128 166/387 |
| 2010/0294510 | A1 | 11/2010 | Holmes | |
| 2011/0100634 | A1* | 5/2011 | Williamson | C09K 8/03 166/310 |
| 2014/0263095 | A1 | 9/2014 | Rodriguez | |
| 2015/0369229 | A1 | 12/2015 | Xiao et al. | |
| 2016/0145980 | A1 | 5/2016 | Cunningham et al. | |
| 2019/0368291 | A1 | 12/2019 | Xiao et al. | |
| 2020/0248532 | A1 | 8/2020 | Gonzalez-Cabrera et al. | |
| 2021/0025260 | A1 | 1/2021 | Frost et al. | |
| 2022/0065068 | A1 | 3/2022 | Mahalingam et al. | |

OTHER PUBLICATIONS

International Search Report issued for corresponding international patent application No. PCT/US2024/012611, mailed Jul. 24, 2024 (8 pages).

Written Opinion issued for corresponding international patent application No. PCT/US2024/012611, mailed Jul. 24, 2024 (14 pages).

J. Chavarria, et al., "Slow-Release Downhole Chemical Treatment in Rod Pump, ESP and Gas Lift, Including a Non-Pulling Tubing Method of Installation," SPE-213056-MS, Society of Petroleum Engineers Oklahoma City Oil and Gas Symposium, Oklahoma City, Oklahoma, USA, Apr. 17-19, 2023 (13 pages).

* cited by examiner

SCALE/CORROSION INHIBITOR DISPENSER FOR WELLBORE PROTECTION

BACKGROUND

Under some downhole conditions, including certain temperatures and pressures, and in the presence of some chemical components, scale or corrosion deposits may build up on exposed surfaces of electrical submersible pump (ESP) components, such as impellers and diffusers. Accumulation of such deposits can cause early pump failure and loss of production, which requires costly workover procedures in order to restore production operations.

Scale and corrosion inhibitor chemicals are often used as a means for preventing accumulation of deposits as fluid passes through the ESP. Some frequently used well dosing procedures to prevent such accumulation include introducing inhibitor chemicals from the surface of the well. For example, a scale squeeze may be performed, which includes bullhead pumping a quantity of chemical treatment down production tubing. Alternatively, chemicals may be pumped continuously down an external chemical injection line strapped to the outside of the production tubing. In water flood production situations, inhibitor chemicals may be introduced in injected fluids. Further, inhibitor sticks, which are composed of solid chemical inhibitors, may be dropped down the production tubing. Another alternative method includes hanging a dispersive chamber below the intake of the ESP, where the dispersive chamber contains chemical treatment.

Despite there being a number of currently implemented solutions, each solution suffers from drawbacks. For example, a scale squeeze operation requires that the well be shut in and that the ESP be stopped, reducing reliability of the situations. Pumping chemicals continuously down a chemical injection line requires a costly chemical injection skid at the surface of the well, increasing the complexity of the entire system. Further, use of chemical injection skids can cause failures in remote desert conditions. With regard to dropping solid chemical inhibitor sticks down the production tubing, this exposes only the area above the ESP to chemicals, and this method therefore does not appropriately treat the various pump stages. A dispersive chamber of chemicals hung below the ESP has finite effectiveness since the chemicals within the chamber will be exhausted after a period of time. Additionally, since the chamber is hung below the ESP intake, the entire system will need to be removed in order to replenish chemicals within the chamber. Finally, water flood production is not widely applicable to a multitude of reservoirs, since it is currently utilized only in specific conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a chemical dispenser system, which may include a Y-tool secured to a toolstring via a Y-block, the Y-tool comprising a bypass line and a pump line, where the bypass line and the pump line are fluidly connected to the toolstring at an upper end of the Y-block and where the pump line and the bypass line are arranged parallel to each other. The chemical dispenser system may further include an electrical submersible pump provided in the pump line, inhibitor chemicals held within one or more pressure retaining chambers in the bypass line, and a blanking plug landed in the bypass line.

In another aspect, embodiments disclosed herein relate to a method of dispensing chemicals inside a wellbore. The method may include creating a scale and corrosion inhibitor program based, at least in part, on wellbore conditions, loading one or more pressure retaining chambers with a volume of inhibitor chemicals and a dissolvable plug, and positioning the one or more pressure retaining chambers into a desired configuration. The method may also include connecting the one or more pressure retaining chambers to a bypass line in a Y-tool, where the Y-tool comprises a pump line held in parallel with and connected to the bypass line via a Y-block, and where an electrical submersible pump is disposed within the pump line. The method may further include running the Y-tool into the wellbore, activating the electric submersible pump, and dispensing inhibitor chemicals over a period of time.

In yet another aspect, embodiments disclosed herein relate to a galvanic chemical dispenser system. The galvanic chemical dispenser system may include a dissolvable plug disposed in a tool body, where the dissolvable plug has a first side and a second side, and where the dissolvable plug is positioned within an electrically insulated non-conducting carrier. The galvanic chemical dispenser system may also include a battery cell operatively connected to the first side of the dissolvable plug, where a volume of wellbore fluids is disposed at the second side of the dissolvable plug. The galvanic chemical dispenser system may further include an electronic timer processor connected between the battery cell and the first side of the dissolvable plug.

In yet another aspect, embodiments disclosed herein relate to a chemical dispenser system. The chemical dispenser system may include a toolstring disposed in a wellbore, and a Y-tool secured to the toolstring via a Y-block, the Y-tool comprising a bypass line and a pump line, where the bypass line and the pump line are fluidly connected to the toolstring at an upper end of the Y-block and where the pump line and the bypass line are arranged parallel to each other. The chemical dispenser system may also include an electrical submersible pump provided in the pump line, and inhibitor chemicals held within one or more pressure retaining chambers in the bypass line, where the one or more pressure retaining chambers are hung from a packer system disposed within the wellbore below the Y-tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-10, any component described with regard to a figure, in various embodiments disclosed herein, may be equivalent to one or more like-named components described with regard to any other figure. For brevity, descriptions of these components may not be repeated for each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

In one aspect, embodiments disclosed herein relate to an apparatus for providing scale and corrosion inhibitor chemicals to an ESP intake in a metered quantity over the lifetime of the ESP. In another aspect, embodiments disclosed herein relate to a method of using the apparatus to dispense inhibitor chemicals and to regularly replenish the inhibitor chemicals as they are dispensed. In yet another aspect, embodiments disclosed herein relate to installing the apparatus in a bypass line of a Y-tool completion to allow for easy access to the apparatus without pulling the tubing from the wellbore.

Figure 1:
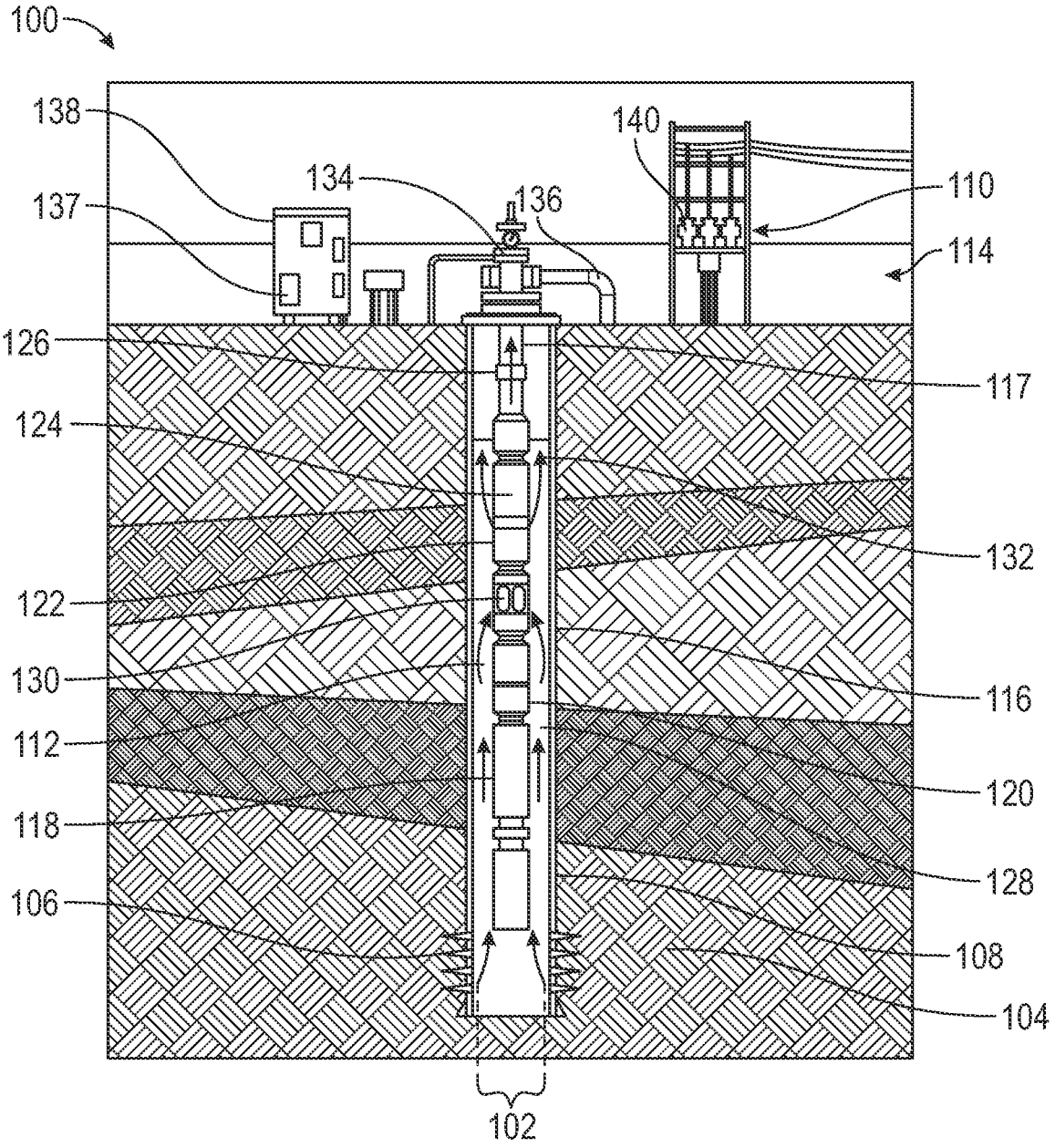
FIG. 1 shows an exemplary ESP system in accordance with one or more embodiments.

FIG. 1 shows an exemplary ESP system 100 in accordance with one or more embodiments. The ESP system 100 is used to help produce formation fluids 102 from a formation 104. Perforations 106 in the well casing 108 provide a conduit for the formation fluids 102 to enter the well 116 from the formation 104. The well 116 may be of vertical orientation or deviated at an angle. A deviated well 116 is well known in the art. The ESP system 100 includes a surface portion having surface equipment 110 and a downhole portion having an ESP string 112.

The ESP string 112 is deployed in a well 116 on production tubing 117, and the surface equipment 110 is located on a surface location 114. The surface location 114 is any location outside of the well 116, such as the Earth's surface. The production tubing 117 extends to the surface location 114 and is made of a plurality of tubulars connected together to provide a conduit for formation fluids 102 to migrate to the surface location 114.

The ESP string 112 may include a motor 118, a motor protector 120, a gas separator 122, a multi-stage centrifugal pump 124 (herein called a "pump" 124), and a power cable 126. The ESP string 112 may also include various pipe segments of different lengths to connect the components of the ESP string 112. The motor 118 is a downhole submersible motor 118 that provides power to the pump 124. The motor 118 may be a two-pole, three-phase, squirrel-cage induction electric motor, permanent magnet motor, or another suitable motor 118. The motor's 118 operating voltages, currents, and horsepower ratings may change depending on the requirements of the operation.

The size of the motor 118 is dictated by the amount of power that the pump 124 requires to lift an estimated volume of formation fluids 102 from the bottom of the well 116 to the surface location 114. The motor 118 is cooled by the formation fluids 102 passing over the motor 118 housing. The motor 118 is powered by the power cable 126. The power cable 126 is an electrically conductive cable that is capable of transferring information. The power cable 126 transfers energy from the surface equipment 110 to the motor 118. The power cable 126 may be a three-phase electric cable that is specially designed for downhole environments. The power cable 126 may be clamped to the ESP string 112 in order to limit power cable 126 movement in the well 116. In further embodiments, the ESP string 112 may have a hydraulic line that is a conduit for hydraulic fluid. The hydraulic line may act as a sensor to measure downhole parameters such as discharge pressure from the outlet of the pump 124.

Motor protectors 120 are located above (i.e., closer to the surface location 114) the motor 118 in the ESP string 112. The motor protectors 120 are a seal section that houses a thrust bearing. The thrust bearing accommodates axial thrust from the pump 124 such that the motor 118 is protected from axial thrust. The seals isolate the motor 118 from formation fluids 102. The seals further equalize the pressure in the annulus 128 with the pressure in the motor 118. The annulus 128 is the space in the well 116 between the casing 108 and the ESP string 112. The pump intake 130 is the section of the ESP string 112 where the formation fluids 102 enter the ESP string 112 from the annulus 128.

The pump intake 130 is located above the motor protectors 120 and below the pump 124. The depth of the pump intake 130 is designed based on the formation 104 pressure, estimated height of formation fluids 102 in the annulus 128, and optimization of pump 124 performance. If the formation fluids 102 have associated gas, then a gas separator 122 may be installed in the ESP string 112 above the pump intake 130 but below the pump 124. The gas separator 122 removes the gas from the formation fluids 102 and injects the gas (depicted as separated gas 132 in FIG. 1) into the annulus 128. If the volume of gas exceeds a designated limit, a gas handling device may be installed below the gas separator 122 and above the pump intake 130.

The pump 124 is located above the gas separator 122 and lifts the formation fluids 102 to the surface location 114. The pump 124 has a plurality of stages that are stacked upon one another. Each stage contains a rotating impeller and stationary diffuser. As the formation fluids 102 enter each stage, the formation fluids 102 pass through the rotating impeller to be centrifuged radially outward gaining energy in the form of velocity.

The formation fluids 102 enter the diffuser, and the velocity is converted into pressure. As the formation fluids 102 pass through each stage, the pressure continually increases until the formation fluids 102 obtain the designated discharge pressure and has sufficient energy to flow to the surface location 114. The ESP string 112 outlined in FIG. 1 may be described as a standard ESP string 112, however, the term ESP string may refer to a standard ESP string or an inverted ESP string without departing from the scope of the disclosure herein.

In one or more embodiments, sensors may be installed in various locations along the ESP string 112 to gather downhole data such as pump intake pressures, discharge pressures, and temperatures. The number of pump stages may be determined prior to installation based of the estimated required discharge pressure. Over time, the formation 104 pressure may decrease and the height of the formation fluids 102 in the annulus 128 may decrease. In these cases, the ESP string 112 may be removed and resized. Once the formation fluids 102 reach the surface location 114, the formation fluids 102 flow through the wellhead 134 into production equipment 136. The production equipment 136 may include any equipment that can gather or transport the formation fluids 102 such as a pipeline or a tank.

The remainder of the ESP system 100 may include various surface equipment 110 such as electric drives 137 and pump control equipment 138 as well as an electric power supply 140. The electric power supply 140 provides energy to the motor 118 through the power cable 126. The electric power supply 140 may be a commercial power distribution system or a portable power source such as a generator.

The pump control equipment 138 is made up of an assortment of intelligent unit-programmable controllers and drives which maintain the proper flow of electricity to the motor 118 such as fixed-frequency switchboards, soft-start controllers, and variable speed controllers. The electric drives 137 may be variable speed drives which read the downhole data, recorded by the sensors, and may scale back or ramp up the motor 118 speed to optimize the pump 124 efficiency and production rate. The electric drives 137 allow the pump 124 to operate continuously and intermittently or be shut-off in the event of an operational problem.

Figure 2A:
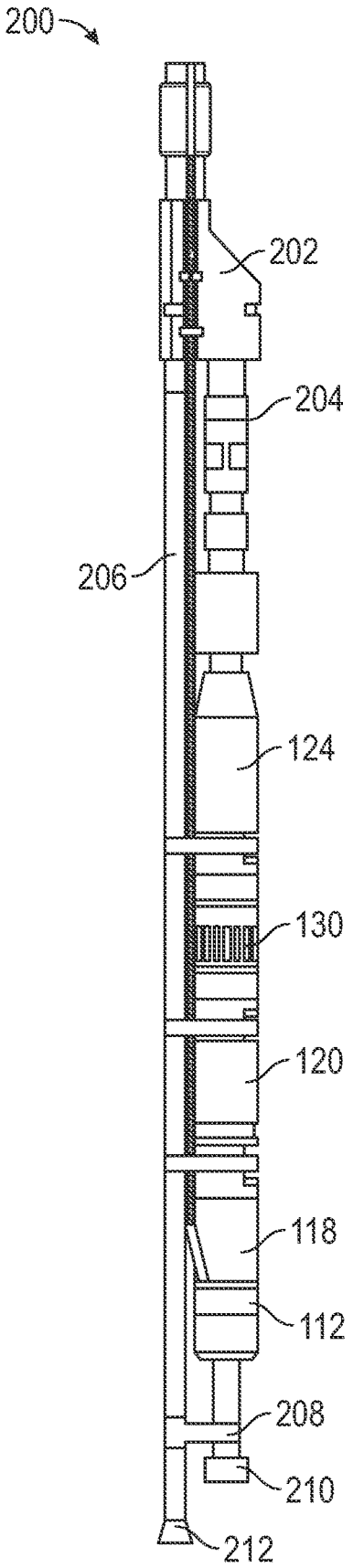
FIGS. 2A and 2B show a Y-tool and ESP assembly in accordance with one or more embodiments.
Figure 2B:
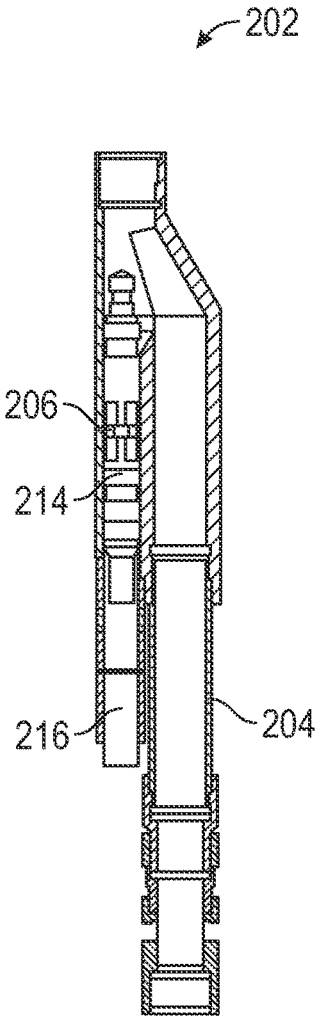

Turning now to FIGS. 2A and 2B, FIGS. 2A and 2B show a Y-tool and ESP assembly in accordance with one or more embodiments. Specifically, FIG. 2A shows an ESP coupled to a Y-block assembly, forming Y-tool assembly 200, and FIG. 2B shows a detailed view of the Y-block assembly. In one or more embodiments, a Y-tool assembly 200 may be secured to a toolstring (e.g., tubing 117 in FIG. 1). The Y-tool assembly 200 may have a Y-block 202, a pump line 204, and a bypass line 206. The pump line 204 forms part of the ESP string 112. The bypass line 206 may extend parallel to the pump line 204. The pump line 204 and the bypass line 206 may be structurally connected via a saddle assembly 208 at a lower axial end of the assembly and may be fluidly connected via the Y-block at an upper axial end of the assembly. The pump line 204 may have an end cap 210 installed at the lower axial end. Similarly, the bypass line 206 may have a re-entry guide 212 installed at the lower axial end.

Turning now to FIG. 2B, a blanking plug 214 may be installed in the bypass line 206 portion of the Y-block 202. A blanking plug 214 may be used to prevent flow of fluids through the bypass line 206 as they pass through the Y-block 202 from the ESP string 112. A bypass plug 216 may be installed below the blanking plug 214.

Figure 3A:
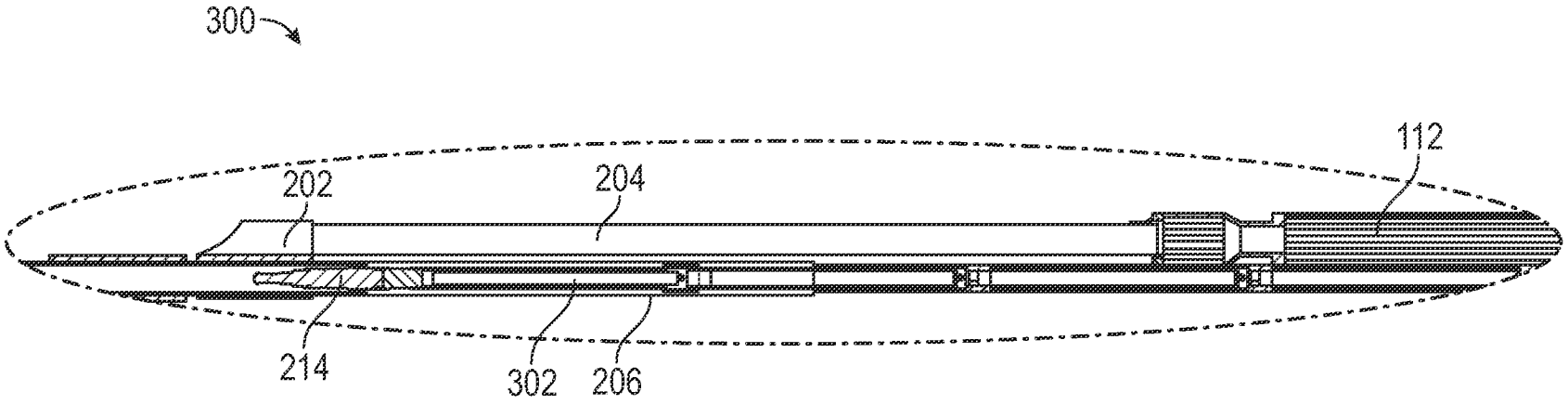
FIGS. 3A and 3B show a chemical dispenser system in accordance with one or more embodiments.

FIG. 3A shows a chemical dispenser system 300 in accordance with one or more embodiments. The chemical dispenser system 300 may include a Y-tool assembly, such as that depicted in FIGS. 2A and 2B. One or more pressure retaining chambers 302 may be disposed within the bypass line 206, below the blanking plug 214. In some embodiments, a first pressure retaining chamber 302 may be secured to the blanking plug 214. Successive pressure retaining chambers 302 may be secured in series, forming a chain which may extend axially through the bypass line 206. In one or more embodiments, the pressure retaining chambers 302 are threadably connected to one another and the blanking plug 214. In other embodiments, the pressure retaining chambers 302 are secured together using any connection method possible between toolstring components without departing from the scope of this disclosure.

Figure 3B:
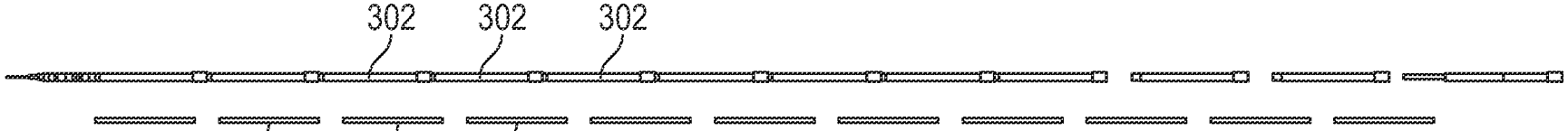

FIG. 3B shows an exploded, disassembled view of the one or more pressure retaining chambers 302 secured within the bypass line 206. Each pressure retaining chamber 302 may contain inhibitor chemicals 304. In one or more embodiments, the inhibitor chemicals 304 may be formed into solid sticks which may be inserted into each pressure retaining chamber 302. In one or more embodiments, each pressure retaining chamber 302 may release the inhibitor chemicals 304 at specific timed intervals. Further, each pressure retaining chamber 302 may release the inhibitor chemicals 304 by diffusion.

Figure 4:
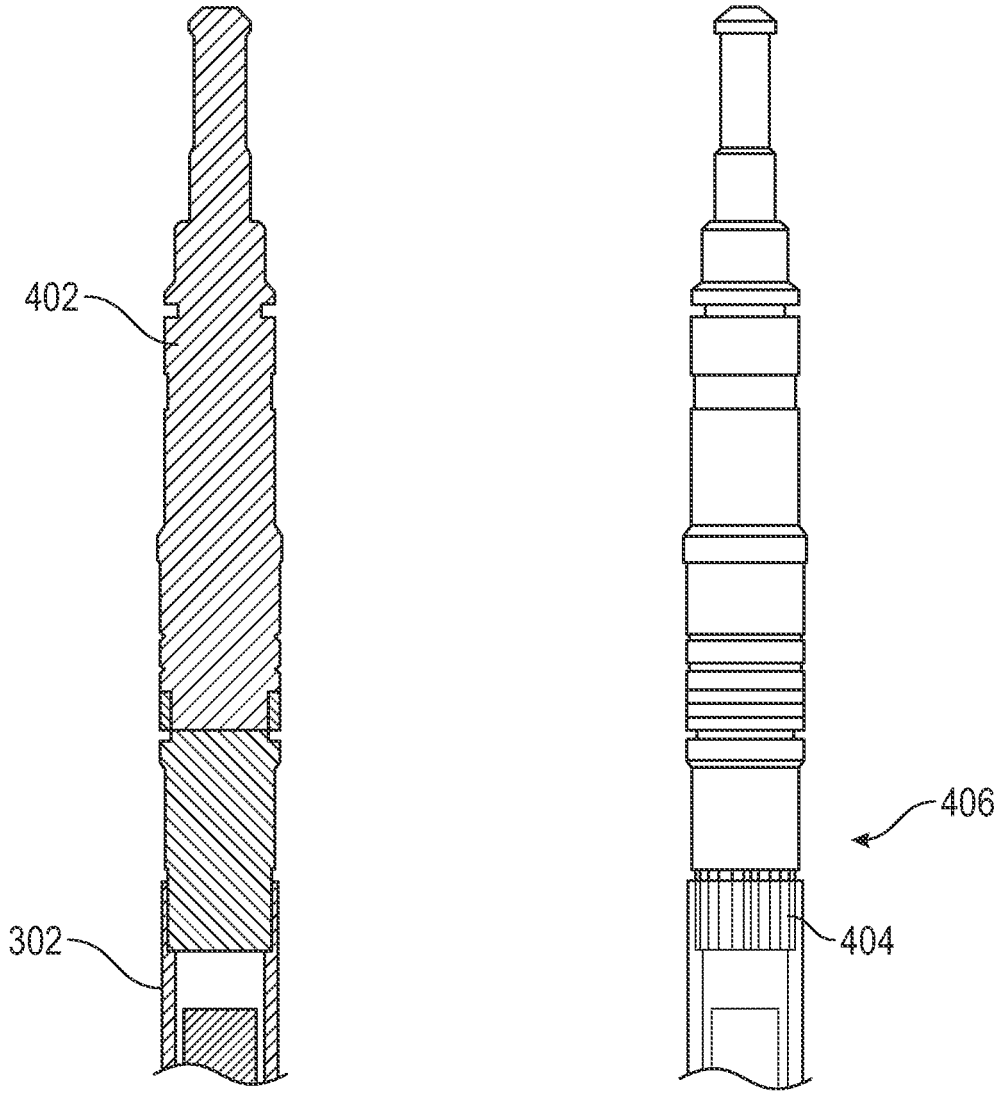
FIG. 4 shows a modified blanking plug in accordance with one or more embodiments.

Turning now to FIG. 4, FIG. 4 shows a modified blanking plug 402 in accordance with one or more embodiments. The modified blanking plug 402 may have a threaded connection 404 disposed at a first end 406. The threaded connection 404 may threadably connect the modified blanking plug 402 to a pressure retaining chamber 302.

In one or more embodiments, the one or more pressure retaining chambers 302 may be hung from an upper axial end of the bypass line 206. Specifically, the one or more pressure retaining chambers 302 may be hung from the bottom of the blanking plug 214 via the threaded connection 404. When the retaining chambers 302 are hung from the upper axial end of the bypass line 206, the blanking plug 214 may still maintain its functionality and be used to prevent recirculation of fluids during pumping operations.

Figure 11:
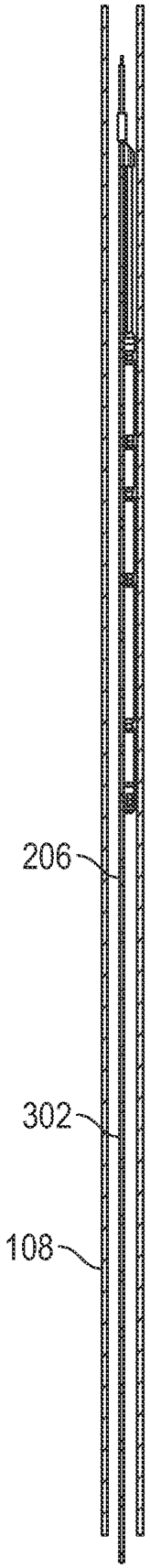
FIG. 11 shows a chemical dispenser system in accordance with one or more embodiments.

In other embodiments, the one or more pressure chambers 302 may be hung at the bottom of the bypass line 206 from a nipple profile. For example, FIG. 11 shows an embodiment in which the one or more pressure retaining chambers 302 are hung from a nipple profile. In such embodiments, the one or more pressure retaining chambers 302 may hang beyond the end of the bypass line 206, such that the one or more pressure retaining chambers 302 are exposed to fluid flow in the well casing 108. In one or more embodiments, the one or more pressure retaining chambers 302 may be hung using a lock profile, which may be pre-existing in the bypass line 206. In other embodiments, the one or more pressure retaining chambers may be hung from a packer-type arrangement, with an attached expansion mechanism (not pictured).

Figure 12:
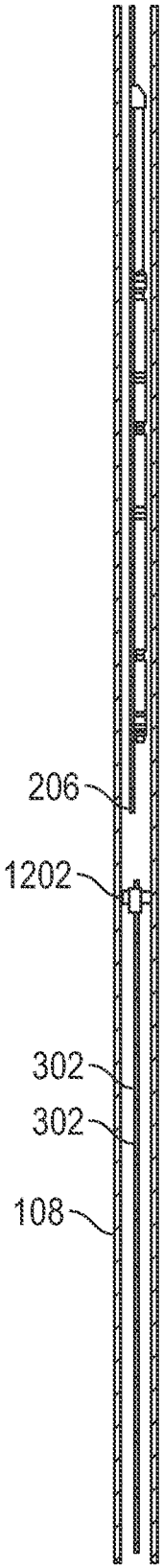
FIG. 12 shows a chemical dispenser system in accordance with one or more embodiments.

In some embodiments, the one or more pressure chambers 302 may be run through the bypass line 206 and into the wellbore below the Y-tool assembly 200. In such embodiments, the one or more pressure chambers 302 may be hung from a packer-type hanger assembly below the Y-tool assembly 200, as shown in FIG. 12. Specifically, the one or more pressure retaining chambers 302 may be hung below (and spaced apart from) the bypass line 206 from a high expansion hanger packer 1202. A conventional tool may be used to retrieve the pressure retaining chambers 302 for replenishment.

Figure 5A:
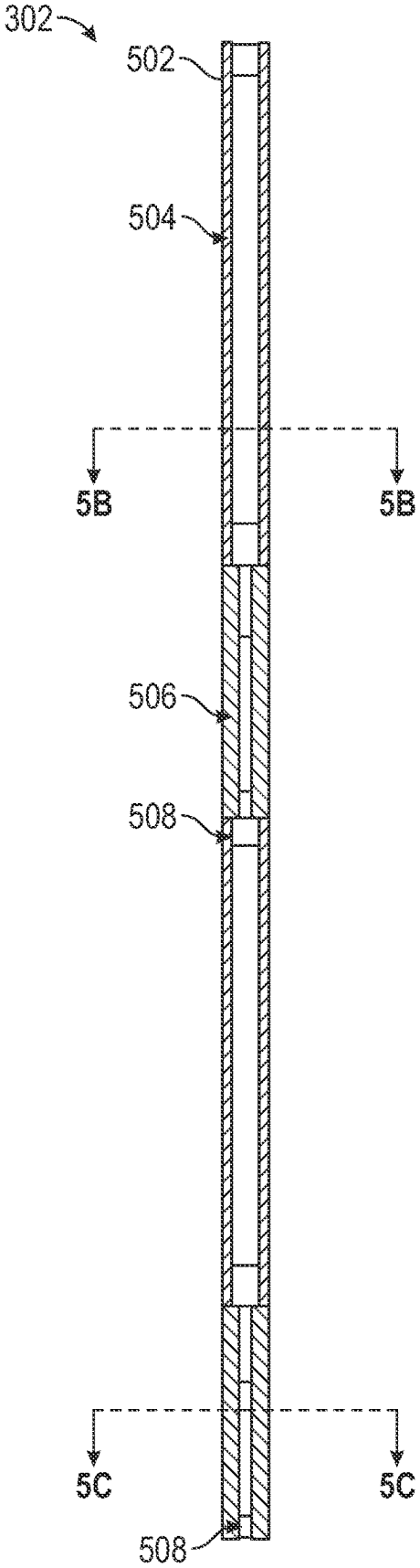
FIGS. 5A-5D show pressure retaining chambers in a series configuration in accordance with one or more embodiments.
Figure 5B:
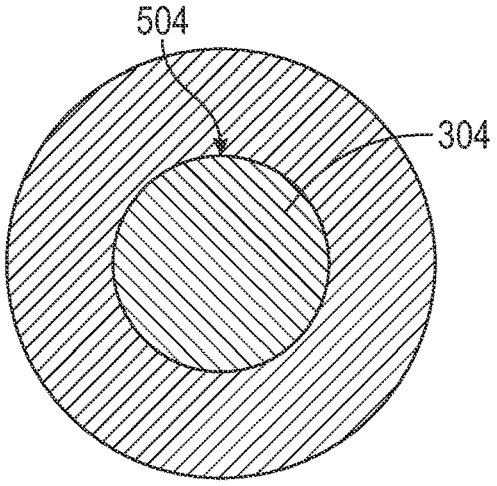
Figure 5C:
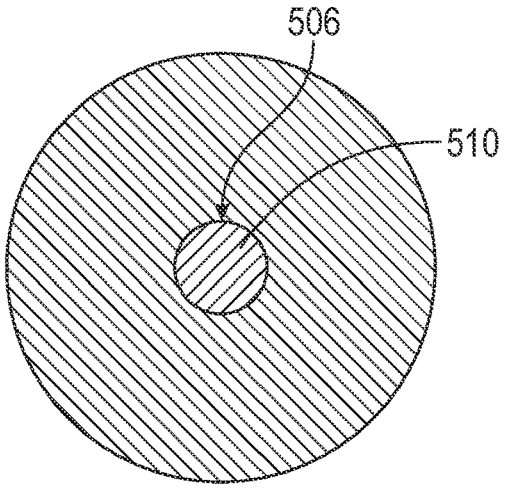

Turning now to FIGS. 5A-5C, FIGS. 5A-5C show pressure retaining chambers 302 in accordance with one or more embodiments. Specifically, FIG. 5A shows two pressure retaining chambers 302 stacked in a series configuration. In one or more embodiments, each pressure retaining chamber 302 may have a steel tubular body 502. An inhibitor chamber 504 and a dissolvable plug chamber 506 may extend axially through the center of the steel tubular body 502.

A dissolvable plug 510 may be disposed within the dissolvable plug chamber 506. According to embodiments of the present disclosure, the dissolvable plug 510 may be fitted within the dissolvable plug chamber 506 such that a majority of the dissolvable plug 510 is sealed within the dissolvable plug chamber 506. Sealing the dissolvable plug 510 within the dissolvable plug chamber 506 may limit the surface area of the dissolvable plug 510 that may be exposed to corrosive wellbore fluids. For example, the dimensions and shape of a dissolvable plug may control the time taken to dissolve the material by limiting surface area exposure via the dissolvable plug chamber to wellbore conditions such as fluids and temperature. In some embodiments, a dissolvable plug 510 may be an elongated shape that is sealed on its sides by the dissolvable plug chamber, such that the end surface area of the dissolvable plug exposed to well fluid (such as brine) is small compared with overall total surface area of the dissolvable plug (where a majority of the plug's surface area is covered by non-dissolving material).

Selective access between the wellbore fluids and the dissolvable plug 510 may be provided by an inhibitor port 508, which may allow the dissolvable plug 510 to dissolve from exposure to the wellbore fluids at a relatively controlled rate, and thereby also allow release of the inhibitor chemicals 304 (initially sealed by the dissolvable plug 510) at a relatively controlled rate. In one or more embodiments, the dissolvable plug 510 may be composed of a metal alloy, an elastomer, or a polymer material, all of which have a tendency to dissolve in the wellbore environment. For example, in some embodiments, the dissolvable plug 510 may be composed of a magnesium aluminum zinc alloy.

In one or more embodiments, the dissolvable plug 510 may be fitted within the steel tubular body 502 by heat shrinking or press-fitting the dissolvable plug 510, which may be rod shaped, into the dissolvable plug chamber 506. Further, one or more elastomeric seals (not pictured) may be used to seal sections of the rod-shaped dissolvable plug 510 along a longitudinal axis, which may assist in providing a sufficient seal and corrosion protection. Alternatively, there may be some embodiments in which the dissolvable plug 510 may be cast into the dissolvable plug chamber 506 within the steel tubular body 502. In such embodiments, a bonded seal may be formed along the entire length of the dissolvable plug 510. With a dissolvable plug 510 sealed within a dissolvable plug chamber 506, the dissolvable plug 510 may retain pressure within the pressure retaining chamber 302.

There may be some embodiments in which the dissolvable plug 510 is non-pressure-retaining. In such embodiments, the pressure retaining chamber 302 may be pressure compensated with the downhole environment via use of an expandable membrane, such as a metal bellows or an elastomeric bag. In one or more embodiments, pressure compensated may refer to the process of equalizing the inner pressure of the chamber with the exterior pressure around the chamber.

An inhibitor port 508 may be disposed between the inhibitor chamber 504 of a first pressure retaining chamber 302 and the dissolvable plug chamber 506 of a second pressure retaining chamber 302. In one or more embodiments, fluids may flow from the first pressure retaining chamber 302 to the second pressure retaining chamber via the inhibitor port 508. Further, stacking pressure retaining chambers 302 in series allows for isolation of successive pressure retaining chambers 302 from ambient fluid for a period of time.

As well fluids flood the dissolvable plug chamber 506, the well fluids may dissolve the dissolvable plug 510 over a period of time. In one or more embodiments, the period of time may be controlled by the length and/or quantity of dissolvable plug material disposed within the dissolvable plug chamber 506. Once the dissolvable plug 510 has been completely dissolved, the inhibitor port 508 may open, allowing well fluids to flood into the inhibitor chamber 504. In one or more embodiments, the inhibitor port 508 may be a pressure plug, which no longer functions after the dissolvable plug 510 has fully dissolved. The inhibitor chemicals 304 may diffuse into the well fluids at a low molecular concentration, providing scale and corrosion inhibition treatment to protect the ESP string 112 (see FIG. 1).

Figure 5D:
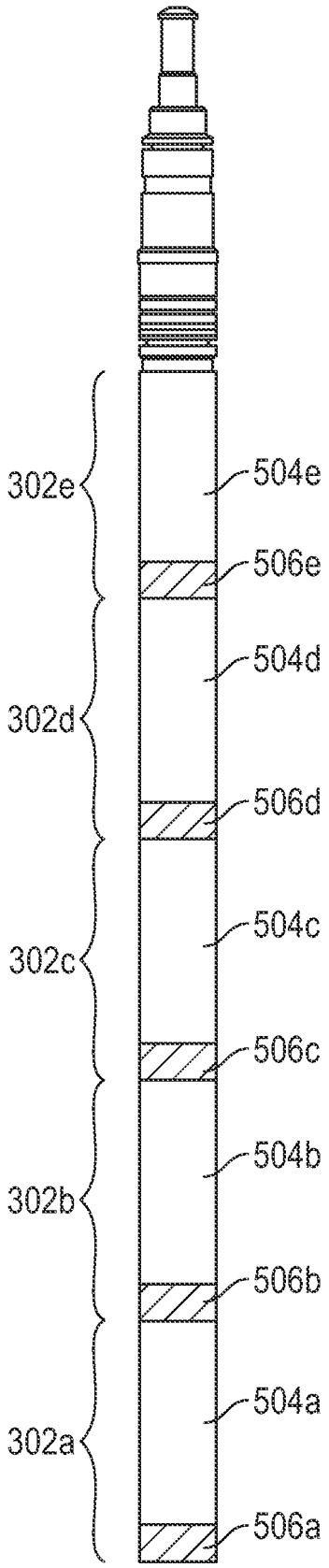

For example, FIG. 5D shows a diagram of a bypass line portion of a Y-tool assembly according to embodiments of the present disclosure having multiple pressure retaining chambers 302*a-e* stacked in a series configuration, as shown in FIG. 5A, where each pressure retaining chamber includes a dissolvable plug chamber 506 and an inhibitor chamber 504. The assembly may include a first pressure retaining chamber 302*a* provided at an axial end of the assembly farthest from the Y-block and blanking plug end of the assembly. When the assembly is provided in a well, a dissolvable plug in a first dissolvable plug chamber 506*a* of the first pressure retaining chamber 302*a* may be exposed to wellbore fluids. A second pressure retaining chamber 302*b* may be provided axially adjacent to the first pressure retaining chamber 302*a* in series, such that a second dissolvable plug chamber 506*b* is disposed axially between a first inhibitor chamber 504*a* in the first pressure retaining chamber 302*a* and a second inhibitor chamber 504*b* in the second pressure retaining chamber 302*b*. Similarly, a third pressure retaining chamber 302*c* may be provided axially adjacent to the second pressure retaining chamber 302*b* in series, such that a third dissolvable plug chamber 506*c* is disposed axially between the second inhibitor chamber 504*b* in the second pressure retaining chamber 302*b* and a third inhibitor chamber 504*c* in the third pressure retaining chamber 302*c*. A fourth pressure retaining chamber 302*d* having a fourth dissolvable plug chamber 506*d* and a fourth inhibitor chamber 504*d* and one or more subsequent pressure retaining chambers 302*e* having dissolvable plug chambers 506*e* and inhibitor chambers 504*e* may likewise be connected in series.

The dissolvable plugs 510 disposed in each dissolvable plug chambers 506*a-e* may be designed to dissolve upon contact with wellbore fluids after a certain amount of time. For example, in the example shown in FIG. 5D, the dissolvable plug in the first dissolvable plug chamber 506*a* may be designed to dissolve between 0 and 2 months. Once the dissolvable plug in the first dissolvable plug chamber 506*a* is dissolved, inhibitor chemicals in the first inhibitor chamber 504*a* may be released into the well.

After the first inhibitor chamber 504*a* is emptied, the dissolvable plug in the second dissolvable plug chamber 506*b* may be exposed to wellbore fluids and dissolve in accordance with the amount of time the plug was designed to take to dissolve. The same process may be repeated for the second, third, fourth, and any subsequent pressure retaining chambers 302*b-e*. In some embodiments, the dissolvable plugs in each dissolvable plug chamber 504*a-e* may be designed to take the same or a similar amount of time to dissolve upon exposure to well fluids. For example, in the example shown in FIG. 5D, after the dissolvable plug in the first dissolvable plug chamber 506*a* dissolves between 0 and 2 months after deployment of the assembly, the dissolvable plug in the second dissolvable plug chamber 506*b* may dissolve between 2 and 4 months after deployment, the dissolvable plug in the third dissolvable plug chamber 506*c* may dissolve between 4 and 6 months after deployment, the dissolvable plug in the fourth dissolvable plug chamber 506*d* may dissolve between 6 and 8 months after deployment, and the dissolvable plugs in subsequent dissolvable plug chambers 506*e* may dissolve in consecutive 0-2 month time frames thereafter. Various other time release schedules may be designed, for example, by selecting dissolvable plug material and size that dissolves according to the time release schedule based on the well fluids expected to contact the dissolvable plugs.

In one or more embodiments, the dissolvable plug 510 may be composed of a dissolvable material such as a metal alloy, an elastomer, or a polymeric material with a tendency to corrode in a wellbore environment. FIG. 5A depicts the dissolvable plug 510 disposed within a steel tubular body 502. However, without departing from the scope of this disclosure, the dissolvable plug 510 may also be disposed within any material which is substantively inert within the wellbore environment.

FIGS. 5B and 5C show radial cross-sectional views of the pressure retaining chamber 302 at cross-sections 5B and 5C, respectively. The inhibitor chamber 504, as shown in FIG. 3B, is disposed centrally within the steel tubular body 502. Similarly, as shown in FIG. 5C, the dissolvable plug chamber 506 is also disposed centrally within the steel tubular body 502.

Figure 6A:
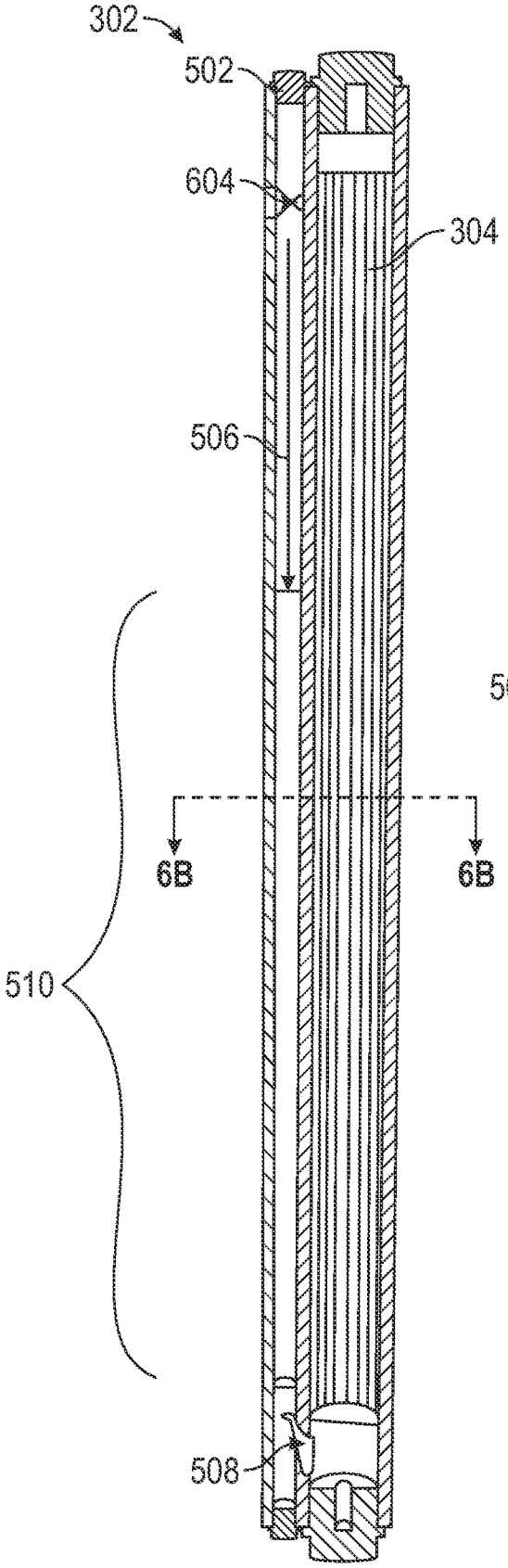
FIGS. 6A and 6B show pressure retaining chambers in a parallel configuration in accordance with one or more embodiments.
Figure 6B:
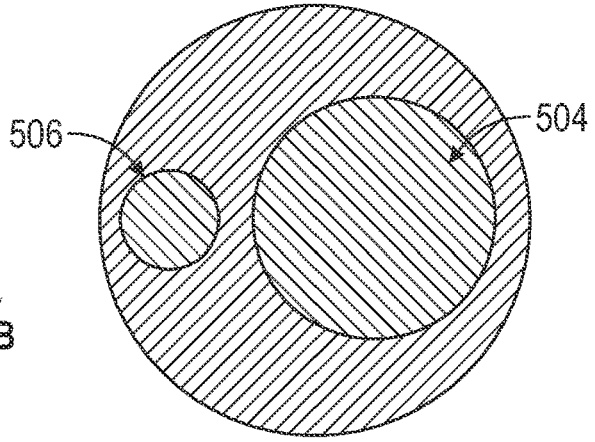

Turning now to FIGS. 6A and 6B, FIGS. 6A-6B show pressure retaining chambers 302 in accordance with one or more embodiments. Specifically, FIG. 6A shows a pressure retaining chamber 302 arranged in a parallel configuration. In a parallel configuration, the inhibitor chamber 504 and the dissolvable plug chamber 506 are positioned parallel to one another within the steel tubular body 502. In one or more embodiments, each pressure retaining chamber 302 arranged in the parallel configuration may have dissolvable plugs 510 of different lengths, which may accordingly completely dissolve at different times when exposed to well fluids. As such, each pressure retaining chamber 302 may release inhibitor chemicals 304 at different time delays from deployment of the system. This may enable constant chemical dosage of the well. When multiple chambers are arranged in a parallel configuration, the one or more pressure retaining chambers 302 may be longitudinally stacked, as shown in FIG. 3B, and the dissolvable plug chambers 506 may be longitudinally stacked parallel with the pressure retaining chambers 302. However, due to the parallel configuration, well fluid may enter each pressure retaining chamber 302 independently at a given time, which may depend on the length of the installed dissolvable plug 510.

When deployed, a well fluid port 604 may provide an inlet through which well fluids may flow from the wellbore into the dissolvable plug chamber 506. In the dissolvable plug chamber 506, the well fluids may contact and dissolve the dissolvable plug 510. Once the dissolvable plug 510 is completely dissolved, well fluids may flow from the dissolvable plug chamber 506, through an inhibitor port 508, and into the inhibitor chamber 504. Additionally, inhibitor chemicals 304 held within the inhibitor chamber 504 may flow out of the inhibitor chamber 504, through the inhibitor port 508, to be released into the well for treatment of an adjacent ESP string (e.g., 112 in FIG. 3A).

FIG. 6B shows a radial cross-sectional view of the pressure retaining chamber 302 at cross-section 6B. The inhibitor chamber 504 and the dissolvable plug chamber 506 each extend axially through the steel tubular body 502. Further, the inhibitor chamber 504 and the dissolvable plug chamber 506 are positioned parallel to one another through the interior of the steel tubular body 502. In one or more embodiments, the inhibitor chamber 504 may have a larger diameter than the dissolvable plug chamber 506. However, there may also be embodiments in which the dissolvable plug chamber 506 has a larger diameter than the inhibitor chamber 504.

An inhibitor chemical dispenser program may be developed for a chemical dispenser system, such as the chemical dispenser system 300 depicted in FIG. 3A. Each pressure retaining chamber 302 may contain a dissolvable plug 510, where the length of the dissolvable plug 510 corresponds to a time required for the dissolvable plug 510 to fully dissolve. In some embodiments, the dissolvable plug 510 may fully dissolve after a period of 2 months or more. The inhibitor chemical dispenser program may include one or more pressure retaining chamber 302, each with a time period for dissolution of the respective dissolvable plug 510. For example, in one exemplary example, the chemical dispenser system may comprise 12 pressure retaining chambers 302 connected in series. Each pressure retaining chamber 302 may contain a dissolvable plug 510 which fully dissolves after a period of about 2 months. Therefore, the inhibitor chemical dispenser program allows for dispensing of inhibitor chemicals from each pressure retaining chamber over a period of 2 months, with a total program length of 24 months, where the total program length refers to the total time required for all dissolvable plugs 510 within the chemical dispenser system to fully dissolve.

Figure 7A:
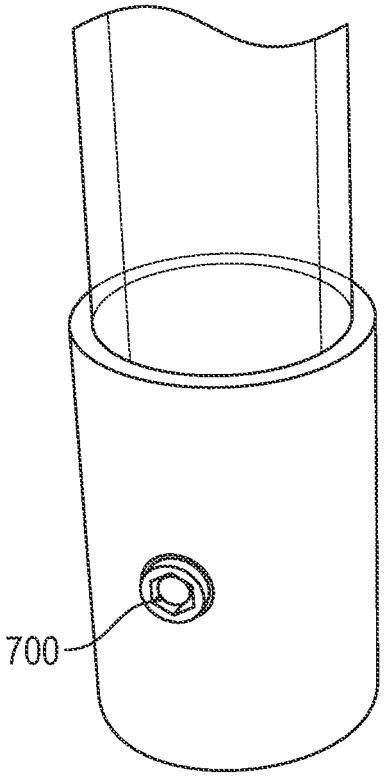
FIGS. 7A and 7B shows a side port disposed on a pressure retaining chamber in accordance with one or more embodiments.
Figure 7B:
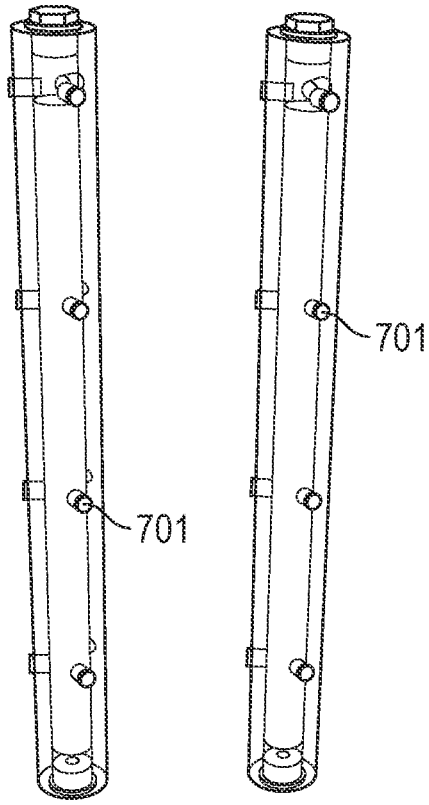

Turning now to FIGS. 7A and 7B, FIGS. 7A and 7B show one or more side ports 700, 701 disposed on a pressure retaining chamber in accordance with one or more embodiments. Particularly, the side port 700 in FIG. 7A is a threaded insert port with a slow dissolving material plugging the flow path through the threaded insert. The side ports 701 in FIG. 7B are holes formed through the chamber that are temporarily blocked with dissolvable materials with varying reactivity rates to control the release of the contents in the chambers at different times. Side ports may provide multiple well fluid exposure points to a dissolvable plug, which may allow for a faster complete dissolve time of the dissolvable plug. Side ports, in accordance with one or more embodiments, may be utilized in parallel configurations. Side ports may be used when the dissolvable plug 510 is composed of a slow dissolving material. In one or more embodiments, a slow dissolving material may refer to any material which may dissolve completely in a time period greater than 8 weeks.

Figure 8:
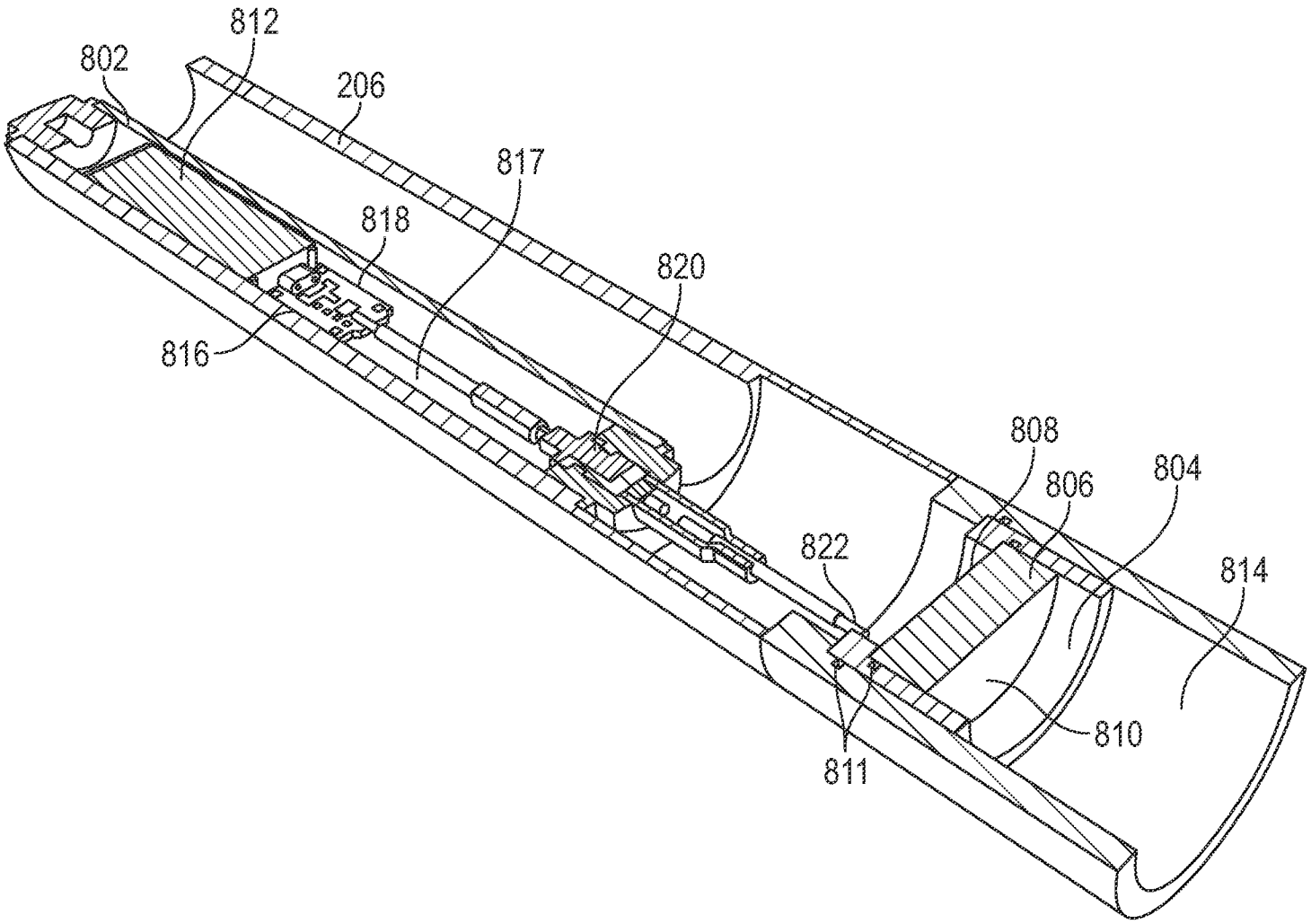
FIG. 8 shows a galvanic chemical dispenser system in accordance with one or more embodiments.

In some embodiments, a dissolvable plug may be designed to dissolve through the use of a connected battery system. For example, FIG. 8 shows a galvanic chemical dispenser system in accordance with one or more embodiments. In one or more embodiments, the galvanic chemical dispenser system 800 may include a tool body 802 which may be disposed on a toolstring within a wellbore. The tool body 802, in accordance with one or more embodiments, may function and be integrated into the bypass line 206 in a substantially similar manner to the pressure retaining chambers 302. Further, multiple tool bodies 802 may be arranged in either a series configuration or a parallel configuration. In one or more embodiments, an electrically insulated non-conducting carrier, such as a polyether ether ketone (PEEK) polymer or a ceramic insulating material may be provided in the tool body 802 to form an insulator 804.

A dissolvable plug 806 may be disposed within the insulator 804 of the tool body 802. In one or more embodiments, the dissolvable plug 806 may be a dissolvable alloy disc. The dissolvable plug 806 may have a first side 808 and an opposite second side 810. One or more O-Ring seals 811 may be secured around the dissolvable plug 806 and/or the insulator 804 to seal an interior chamber from wellbore fluids 814. A battery cell 812 may be operatively connected to the first side 808 of the dissolvable plug 806 via an anode 822. Wellbore fluids 814 may be located at the second side 810 of the dissolvable plug 806. In one or more embodiments, the wellbore fluids 814 may contain chlorides or other electrolytes. When the dissolvable plug 806 is exposed to electrolytes at its second side 810 and when the battery cell 812 is electrically operated, electrons may be supplied from the dissolvable plug 806, which may act as an active material, to the anode 822, which may act as a passive material. Through this galvanic process, dissolving of the dissolvable plug 806 may be accelerated.

A timer processor 816 may be connected between the battery cell 812 and the first side 808 of the dissolvable plug 806 in an electronics chamber 817. A cathode 818 may be positioned proximate the timer processor 816 and may be connected to the tool body 802. A bulkhead connector 820 may be disposed at one end of the electronics chamber 817, and an anode 822 may extend from the bulkhead connector 820, terminating proximate the first side 808 of the dissolvable plug 806.

In one or more embodiments, the battery cell 812 may be configured to apply a DC voltage to the first side 808 of the dissolvable plug 806. Application of the DC voltage may accelerate dissolution of the dissolvable plug 806. Further, application of the DC voltage may create a galvanic cell between the dissolvable plug 806, the wellbore fluids 814, and battery cell 812. The DC voltage may be applied upon receipt of a timer command from the electronic timer processor 816. In one or more embodiments, the electronic timer processor 816 may be configured to receive operator instructions and to activate the battery cell 812 based, at least in part, on the operator instructions.

Figure 9:
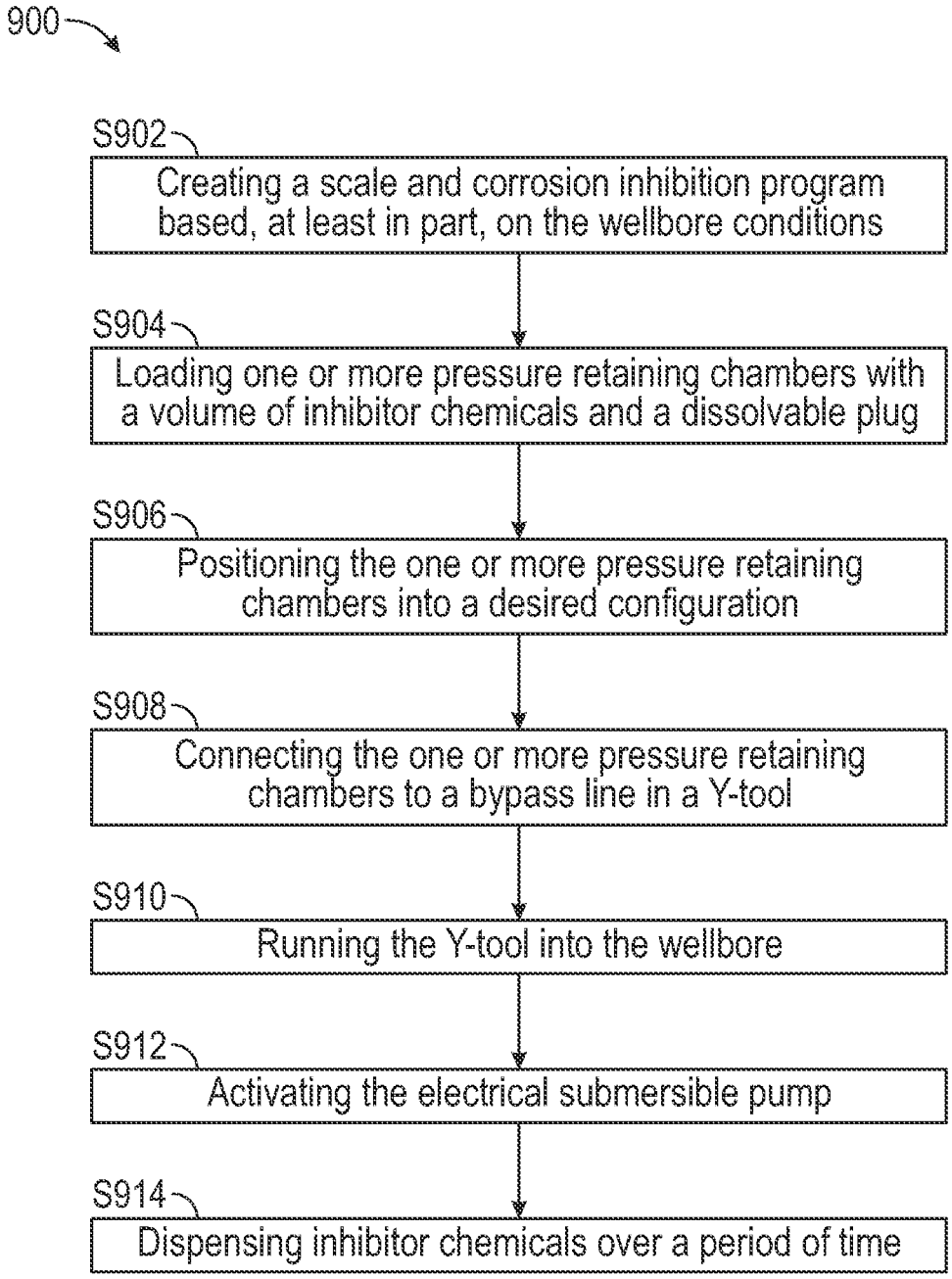
FIG. 9 shows a flowchart of a method in accordance with one or more embodiments.

FIG. 9 depicts a flowchart in accordance with one or more embodiments. More specifically, FIG. 9 depicts a flowchart 900 of a method of dispensing chemicals within a wellbore. Further, one or more blocks in FIG. 9 may be performed by one or more components as described in FIGS. 1-8. While the various blocks in FIG. 9 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a scale and corrosion inhibition program is created based, at least in part, on the wellbore conditions, S902. In one or more embodiments, creating the scale and corrosion inhibition program may include calculating a quantity of required inhibitor chemicals 304, a required type of inhibitor chemicals 304, and a desired duration of scale and corrosion inhibition. Further, a dissolvable plug 510, including shape, size (e.g., length) and material, may be selected in order to achieve the desired duration of scale and corrosion inhibition. The dissolvable plug may be selected such that the total time required for all of the dissolvable plugs disposed within the one or more pressure retaining chambers to fully dissolve would be equal to the desired duration of scale and corrosion inhibition.

Next, one or more pressure retaining chambers 302 may be loaded with a volume of inhibitor chemicals 304 and the selected dissolvable plug 510, S904. Once loaded, the pressure retaining chambers 302 may be positioned into a desired configuration, S906. In one or more embodiments, the pressure retaining chambers 302 may be positioned into a series configuration. However, there are other embodiments in which the pressure retaining chambers 302 may be positioned into a parallel configuration.

The pressure retaining chambers 302 may then be connected to a bypass line 206 of a Y-tool assembly 200, S908. In one or more embodiments, the pressure retaining chambers 302 may be threadably connected to a lower axial end of a blanking plug 214 and may extend through the bypass line 206. A pump line 204, containing an ESP, may held in parallel with and connected to the bypass line 206 via a Y-block 202.

Once the pressure retaining chambers 302 are secured to the bypass line 204 and the Y-tool assembly is assembled, the Y-tool assembly 200 may be run into the wellbore on a toolstring, S910. When the Y-tool assembly 200 has reached a desired depth within the wellbore, the electrical submersible pump may be activated, S912.

Inhibitor chemicals 304 may then be dispensed over a period of time, S914. In one or more embodiments, dispensing inhibitor chemicals 304 may include introducing well fluids to a first of the one or more pressure retaining chambers 302. In some embodiments, the first of the one or more pressure retaining chambers 302 may be located at a lower axial end of the bypass line 206, where the pressure retaining chambers 302 are stacked in series. The dissolvable plug 510 may be dissolved in the well fluids, where the length of the dissolvable plug 510 may at least partially determine its dissolution time.

Dispensing inhibitor chemicals 304 may further include equalizing the pressure in the first pressure retaining chamber 302 with an ambient well pressure. Once the dissolvable plug 510 has fully dissolved, the first pressure retaining chamber 302 may be flooded with well fluids. The inhibitor chemicals 304 may then diffuse into the well fluids at a low molecular concentration.

In one or more embodiments, the method may further include dispensing inhibitor chemicals 304 from each of the one or more pressure retaining chambers 302 successively. In some embodiments, this may include successively dispensing from the one or more pressure chambers 302 stacked in series, where chemicals may be dispensed from a first chamber located at a lower axial end of the bypass line 206, and then through each successive pressure retaining chamber 302 until the final pressure retaining chamber 302 is reached at an upper axial end of the bypass line 206.

Figure 10:
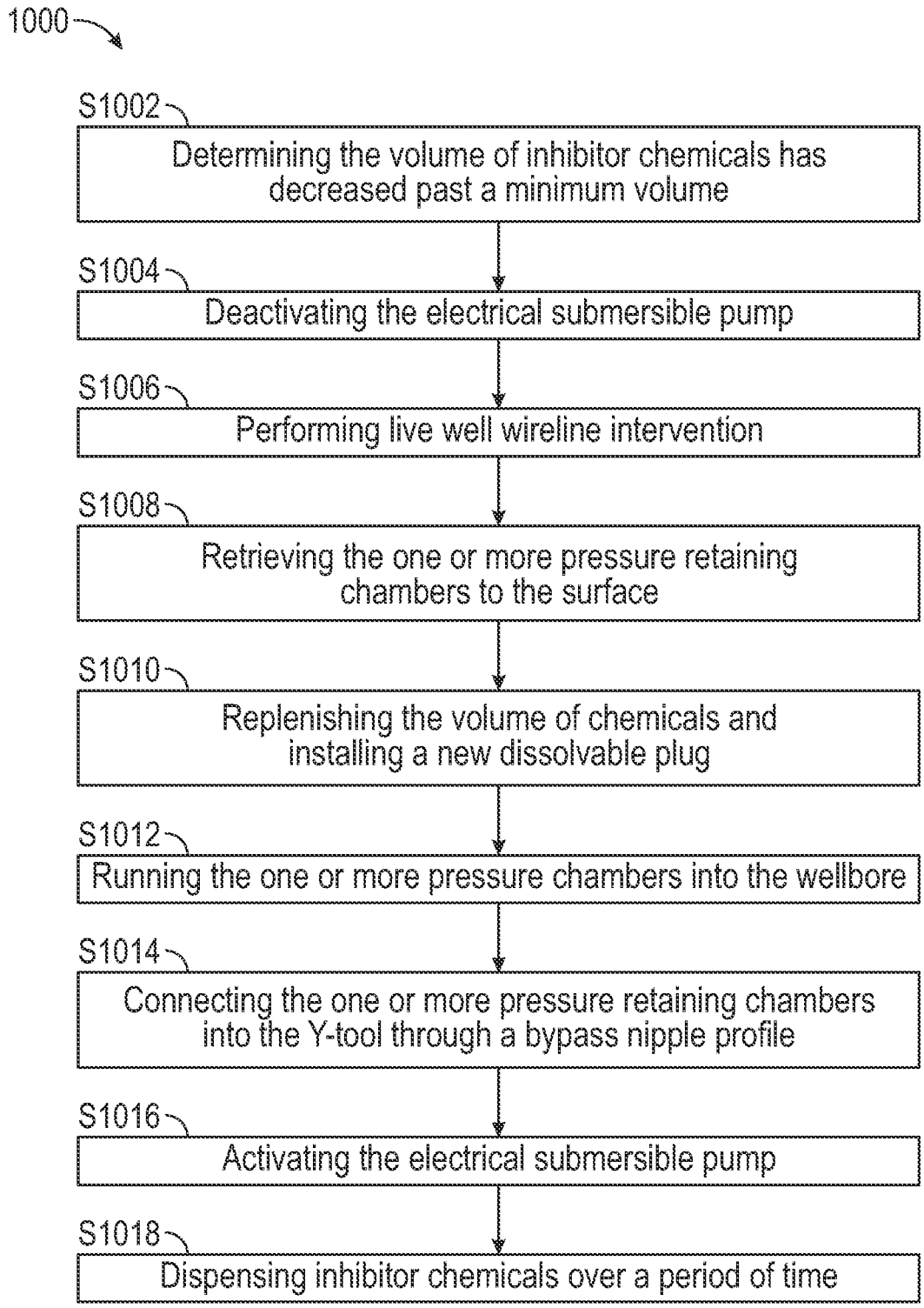
FIG. 10 shows a flowchart of a method in accordance with one or more embodiments.

FIG. 10 depicts a flowchart in accordance with one or more embodiments. More specifically, FIG. 10 depicts a flowchart 1000 of a method of replenishing chemicals within a chemical dispenser system without removing a toolstring from a wellbore. Further, one or more blocks in FIG. 10 may be performed by one or more components as described in FIGS. 1-8. While the various blocks in FIG. 10 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

The method depicted in flowchart 1000 may be performed following the method depicted in FIG. 9. Once all of the dissolvable plugs 510 have been dissolved and substantially all of the inhibitor chemicals 304 have been dispensed, the one or more pressure retaining chambers 302 may be empty. As such, the one or more pressure retaining chambers 302 require replenishment in order for continued scale and corrosion inhibition.

Initially, it may be determined that the volume of inhibitor chemicals 304 has decreased past a minimum volume, S1002. In one or more embodiments, when the volume of inhibitor chemicals 304 in the final of the one or more pressure retaining chambers 302 has decreased a minimum volume, the one or more pressure retaining chambers 302 may be considered to be substantially empty. The minimum volume, for example, may be a volume less than 5% of the original volume. In one or more embodiments, determining that the volume of inhibitor chemicals 304 has decreased past the minimum value may include performing periodic surveillance fluid sampling to detect a minimum inhibitor chemical concentration in a volume of produced fluids.

Once the volume of inhibitor chemicals 304 has decreased past the minimum volume, the electrical submersible pump may be deactivated, S1004. Live well wireline intervention may be performed, S1006. This wireline intervention may allow for the retrieval of the blanking plug 214 and the one or more pressure retaining chambers 302 to the surface, S1008. While at the surface, each pressure retaining chamber 302 may be filled with a replenished volume of inhibitor chemicals 304 and a new dissolvable plug 510, S1010. Further, the blanking plug 214 may be redressed.

After replenishment of the inhibitor chemicals 304 and installation of a new dissolvable plug 510, the one or more pressure retaining chambers 302 may be run into the wellbore, S1012. Once the chambers reach the desired depth, the one or more pressure retaining chambers 302 may be connected into the bypass line 206 of the Y-tool assembly 200, S1014. In one or more embodiments, connecting into the bypass line 206 may include latching the one or more pressure retaining chambers 302 into a Y-tool bypass nipple profile. In one or more embodiments, the pressure retaining chambers 302 may be deployed using the same tools as may be used to install the blanking plug 214. For example, in one or more embodiments, the blanking plug 214 may be run on a slickline with a running tool.

Once the one or more pressure retaining chambers 302 are connected back into the Y-tool assembly 200, the electrical submersible pump (ESP) may be reactivated, S1016. Dispensing of inhibitor chemicals over a period of time may the recommence, S1018.

The method depicted in flowchart 1000 may be repeated for the entire life of the production operation of the well. When the system is replenished, the same scale and corrosion inhibition program may be used. However, there may also be embodiments in which a different scale and corrosion inhibition program is utilized, resulting in a different dissolvable plug 510 being used after replenishment than was used originally.

Embodiments of the present disclosure may provide at least one of the following advantages. Scale and corrosion of electrical submersible pump systems is a known cause of premature failure of equipment. As a result of system failures, costly workover and significant well downtime may be required to replace failed components. Use of a scale and corrosion inhibition system, such as the chemical dispenser system disclosed herein, may prevent system failures, reducing costly workover and increasing well uptime during production.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A chemical dispenser system, comprising:

a Y-tool secured to a toolstring via a Y-block, the Y-tool comprising a bypass line and a pump line, wherein the bypass line and the pump line are fluidly connected to the toolstring at an upper end of the Y-block;

wherein the pump line and the bypass line are arranged parallel to each other;

an electrical submersible pump provided in the pump line;

inhibitor chemicals held within one or more pressure retaining chambers in the bypass line; and a blanking plug landed in the bypass line, wherein the one or more pressure retaining chambers are threadably connected below the blanking plug, opposite the upper end of the Y-block.

2. The chemical dispenser system of claim 1, wherein the one or more pressure retaining chambers release chemicals at timed intervals.

3. The chemical dispenser system of claim 1, wherein the one or more pressure retaining chambers are hung from an upper axial end of the bypass line.

4. The chemical dispenser system of claim 1, wherein the one or more pressure retaining chambers are hung at a lower axial end of the bypass line from a nipple profile.

5. The chemical dispenser system of claim 1, wherein each of the one or more pressure retaining chambers comprises:

a steel tubular body;

a dissolvable plug chamber extending axially through the steel tubular body;

an inhibitor chamber extending axially through the steel tubular body, wherein the dissolvable plug chamber and the inhibitor chamber are stacked in series within the steel tubular body; and an inhibitor port disposed between the dissolvable plug chamber and the inhibitor chamber.

6. The chemical dispenser system of claim 5, wherein a dissolvable plug is disposed within the dissolvable plug chamber.

7. The chemical dispenser system of claim 6, where the dissolvable plug is selected from a group consisting of a metal alloy, an elastomer, or a polymer.

8. The chemical dispenser system of claim 6, wherein the dissolvable plug is fitted with one or more elastomeric seals.

9. The chemical dispenser system of claim 1, wherein each of the one or more pressure retaining chambers comprises:

a steel tubular body;

a dissolvable plug chamber extending axially through the steel tubular body;

an inhibitor chamber extending axially through the steel tubular body and arranged parallel to the dissolvable plug chamber, wherein a length of the dissolvable plug chamber is less than a length of the inhibitor chamber;

a well fluid chamber extending axially through the steel tubular body and arranged in series with the dissolvable plug chamber;

a well fluid port disposed between the well fluid chamber and the inhibitor chamber; and an inhibitor port disposed between the dissolvable plug chamber and the inhibitor chamber.

10. The chemical dispenser system of claim 9, wherein each of the dissolvable plug chambers contains a dissolvable plug.

11. The chemical dispenser system of claim 10, wherein each dissolvable plug has a different length and wherein each of the different lengths corresponds to a desired dissolution time.

12. A method of dispensing chemicals inside a wellbore, comprising:

creating a scale and corrosion inhibitor program based, at least in part, on wellbore conditions, wherein creating the scale and corrosion inhibitor program comprises a quantity of inhibitor chemicals, a type of inhibitor chemicals, and a duration of scale and corrosion inhibition;

loading one or more pressure retaining chambers with a volume of inhibitor chemicals and a dissolvable plug;

positioning the one or more pressure retaining chambers into a desired configuration;

connecting the one or more pressure retaining chambers to a bypass line in a Y-tool, wherein the Y-tool comprises a pump line held in parallel with and connected to the bypass line via a Y-block, and wherein an electrical submersible pump is disposed within the pump line;

running the Y-tool into the wellbore;

activating the electric submersible pump; and dispensing inhibitor chemicals over a period of time.

13. The method of claim 12, further comprising:

determining the volume of inhibitor chemicals has decreased past a minimum volume;

deactivating the electric submersible pump;

performing live well wireline intervention;

retrieving the one or more pressure retaining chambers to a surface location;

replenishing the volume of chemicals and installing a new dissolvable plug;

running the one or more pressure retaining chambers into the wellbore;

connecting the one or more pressure retaining chambers into the Y-tool through a bypass nipple profile;

activating the electric submersible pump; and dispensing inhibitor chemicals over a period of time.

14. The method of claim 13, wherein determining the volume of inhibitor chemicals has decreased past the minimum volume comprises performing periodic surveillance fluid sampling to detect a minimum inhibitor chemical concentration present in a volume of produced fluids.

15. The method of claim 13, wherein dispensing inhibitor chemicals over a period of time comprises:

introducing well fluids to a first of the one or more pressure retaining chambers, wherein the one or more pressure retaining chambers are stacked in series;

dissolving the dissolvable plug in the well fluids, wherein a length of the dissolvable plug determines a dissolution time;

equalizing a pressure in the first pressure retaining chamber with an ambient well pressure;

flooding the first pressure retaining chamber with well fluids; and diffusing the inhibitor chemicals into the well fluids at a low molecular concentration.

16. The method of claim 15, further comprising dispensing inhibitor chemicals from each of the one or more pressure retaining chambers successively.

17. The method of claim 12, further comprising selecting a dissolvable plug to achieve the desired duration of scale and corrosion inhibition.

* * * * *